US011452186B1

(12) United States Patent
Zhou et al.

(10) Patent No.: US 11,452,186 B1
(45) Date of Patent: Sep. 20, 2022

(54) LED DRIVER WITH RECTIFIED VOLTAGE MONITOR

(71) Applicant: Cuvee Systems, Inc., San Jose, CA (US)

(72) Inventors: Dongsheng Zhou, Cupertino, CA (US); Lanh Cong Nguyen, Santa Clara, CA (US)

(73) Assignee: Cuvee Systems, Inc., San Jose, CA (US)

( * ) Notice: Subject to any disclaimer, the term of this patent is extended or adjusted under 35 U.S.C. 154(b) by 0 days.

(21) Appl. No.: 17/529,858

(22) Filed: Nov. 18, 2021

(51) Int. Cl.
*H05B 45/30* (2020.01)
*H05B 45/37* (2020.01)
*H05B 45/14* (2020.01)

(52) U.S. Cl.
CPC ..... *H05B 45/14* (2020.01); *H05B 45/30* (2020.01)

(58) Field of Classification Search
CPC ..... H05B 45/10; H05B 45/14; H05B 45/30; H05B 45/37; H05B 45/3725
See application file for complete search history.

(56) References Cited

U.S. PATENT DOCUMENTS

2008/0278092 A1* 11/2008 Lys ..... H05B 45/385 315/247
2011/0109245 A1* 5/2011 Lin ..... H05B 45/44 315/294
2014/0265898 A1* 9/2014 Del Carmen, Jr. .... H05B 45/31 315/307
2015/0257217 A1* 9/2015 Ido ..... H05B 45/375 315/246

OTHER PUBLICATIONS

Monolithic Power Systems, "EV4031-S-00A 108Vac~305Vac, 30V/530mA Primary-side-control with Active PFC TRIAC and Analog Dimmable LED Driver EVB" Rev. 1.01, Nov. 25, 2014.
Cai, Jiali, "MP4033: Application Note for a TRIAC-Dimmable, Offline LED Controller with Primary-Side Control and Active PFC", Monolithic Power Systems, Apr. 18, 2014.
Monolithic Power Systems, "MP4033 TRIAC-Dimmable, Offline LED Controller with Primary-Side Control and Active PFC", Rev 1.0, Oct. 22, 2014.

* cited by examiner

*Primary Examiner* — Thai Pham
(74) *Attorney, Agent, or Firm* — Spano Law Group; Joseph S. Spano

(57) ABSTRACT

Methods and systems for improved dimming of LED based illumination devices are described herein. An AC input voltage provided to an LED driver is rectified and the rectified signal is monitored by a Rectified Voltage Monitor (RVM) circuit. The RVM circuit generates a low voltage monitor signal indicative of the shape and peak voltage of the rectified signal. The monitor signal and the rectified signal are communicated to a power converter of the LED driver. The controller of the power converter employs the monitor signal to maintain efficiency and stability of the LED driver over an extended range of AC input voltage. The instantaneous voltage of the rectified signal is divided-down, and the peak value of the divided-down rectified signal is captured and stored on one or more capacitive elements. In another aspect, the peak voltage stored on one or more capacitive elements is less than 100 Volts.

20 Claims, 6 Drawing Sheets

LED DRIVER WITH RECTIFIED VOLTAGE MONITOR

TECHNICAL FIELD

The described embodiments relate to electrical power conversion and control, and more specifically, to electrical power conversion and control for solid state lighting devices.

BACKGROUND INFORMATION

Light emitting diode (LED) based illumination devices have emerged as a preferred technology for general illumination. The high efficiency of LEDs reduces electrical power consumption, making LEDs an environmentally attractive lighting solution. In many examples, municipalities at the city, state, and national level have enacted regulations requiring a transition from the use of incandescent light bulbs to LED based lighting devices.

Although incandescent bulbs are undesirable from the point of view of efficiency, dimming of incandescent bulbs is relatively simple. Traditionally, incandescent bulbs are dimmed by controlling the voltage supplied to the resistive filament itself. As the voltage is reduced, the current flow through the resistive filament is reduced, resulting in a reduction in light output. Conversely, as voltage is increased, the current flow through the resistive filament is increased, resulting in an increase in light output of the bulb. Various schemes have been developed to control the voltage supplied to the resistive filament of an incandescent lamp from a fixed AC electrical power source.

LEDs are by nature a diode, rather than a resistor. The light emitted from a conventional LED depends on the current supplied to the LED at a relatively low direct current (DC) voltage. In many practical applications, dimming the light output from an LED requires control of the current supplied to the LED and conversion of the relatively high AC input voltage to a low DC voltage.

The voltage level available from the electrical power grid varies depending on the adopted standard for electrical power. The adopted standard may depend on application (e.g., residential, industrial, etc.) and location (e.g., different countries). In some examples, the AC voltage level available from the electrical power grid may be anywhere in a range from 108 VAC to 300 VAC. Various schemes have been developed to achieve LED dimming from a fixed AC electrical power source. However, current circuit designs are often unable to accommodate a large range of AC input voltage. Thus, different LED driver circuits or circuit elements are required depending on the application and location of installation. This complicates the supply chain for LED drivers as different LED drivers or differently configured LED drivers are required depending on the installation.

In summary, it is desirable to improve LED utilization and adoption by increasing the acceptable range of AC input voltage of a dimmable LED driver.

SUMMARY

Methods and systems for improved dimming of LED based illumination devices are described herein. An AC input voltage provided to an LED driver is rectified and the rectified signal is monitored by a Rectified Voltage Monitor (RVM) circuit. The RVM circuit generates a low voltage, direct current monitor signal, e.g., less than 5 Volts, indicative of the shape and peak voltage of the rectified signal. The monitor signal and the rectified signal are communicated to a power converter of the LED driver. The controller of the power converter employs the monitor signal to maintain efficiency and stability of the LED driver over an extended range of AC input voltage.

In one aspect, the instantaneous voltage of the rectified signal is divided-down. The peak value of the divided-down rectified signal is captured and stored on one or more capacitive elements. The peak value is provided to the control node of an electrical switching element, e.g., a transistor. In addition, a voltage divider divides down the instantaneous voltage of the rectified signal. The fraction by which the voltage divider circuit divides down the rectified signal is controlled by the state of the switching element. In this manner, the amplitude of the monitor signal generated by the RVM circuit is based on the peak value of the rectified signal.

A rectified voltage monitor operates to monitor the rectified voltage over a relatively large range of peak voltage values and generate a stable, monitor signal representative of the shape and amplitude of the rectified voltage. In some embodiments, the peak voltage of the rectified signal is in a range from 150 Volts to 450 Volts, while the corresponding peak voltage of the monitor signal ranges from 0 Volts to 2 Volts.

In another aspect, the peak voltage stored on one or more capacitive elements of the rectified voltage monitor is less than 100 Volts, 60 Volts, 10 Volts, or 5 Volts. By storing such a low voltage, a SMT capacitor may be utilized, rather than a high voltage electrolytic capacitor.

The foregoing is a summary and thus contains, by necessity, simplifications, generalizations and omissions of detail; consequently, those skilled in the art will appreciate that the summary is illustrative only and is not limiting in any way. Other aspects, inventive features, and advantages of the devices and/or processes described herein will become apparent in the non-limiting detailed description set forth herein.

DETAILED DESCRIPTION

Reference will now be made in detail to background examples and some embodiments of the invention, examples of which are illustrated in the accompanying drawings.

Methods and systems for improved dimming of LED based illumination devices are described herein. An AC input voltage provided to an LED driver is rectified and the rectified signal is monitored by a Rectified Voltage Monitor (RVM) circuit. The RVM circuit generates a low voltage, direct current monitor signal, e.g., less than 5 Volts, indicative of the shape and peak voltage of the rectified signal. The monitor signal and the rectified signal are communicated to a power converter of the LED driver. The controller of the power converter employs the monitor signal to maintain efficiency and stability of the LED driver over an extended range of AC input voltage.

In one aspect, the instantaneous voltage of the rectified signal is divided-down. The peak value of the divided-down rectified signal is captured and stored on one or more capacitive elements. The peak value is provided to the control node of an electrical switching element, e.g., a transistor. In addition, a voltage divider divides down the instantaneous voltage of the rectified signal. The fraction by which the voltage divider circuit divides down the rectified signal is controlled by the state of the switching element. In this manner, the amplitude of the monitor signal generated by the RVM circuit is based on the peak value of the rectified signal.

Figure 1:
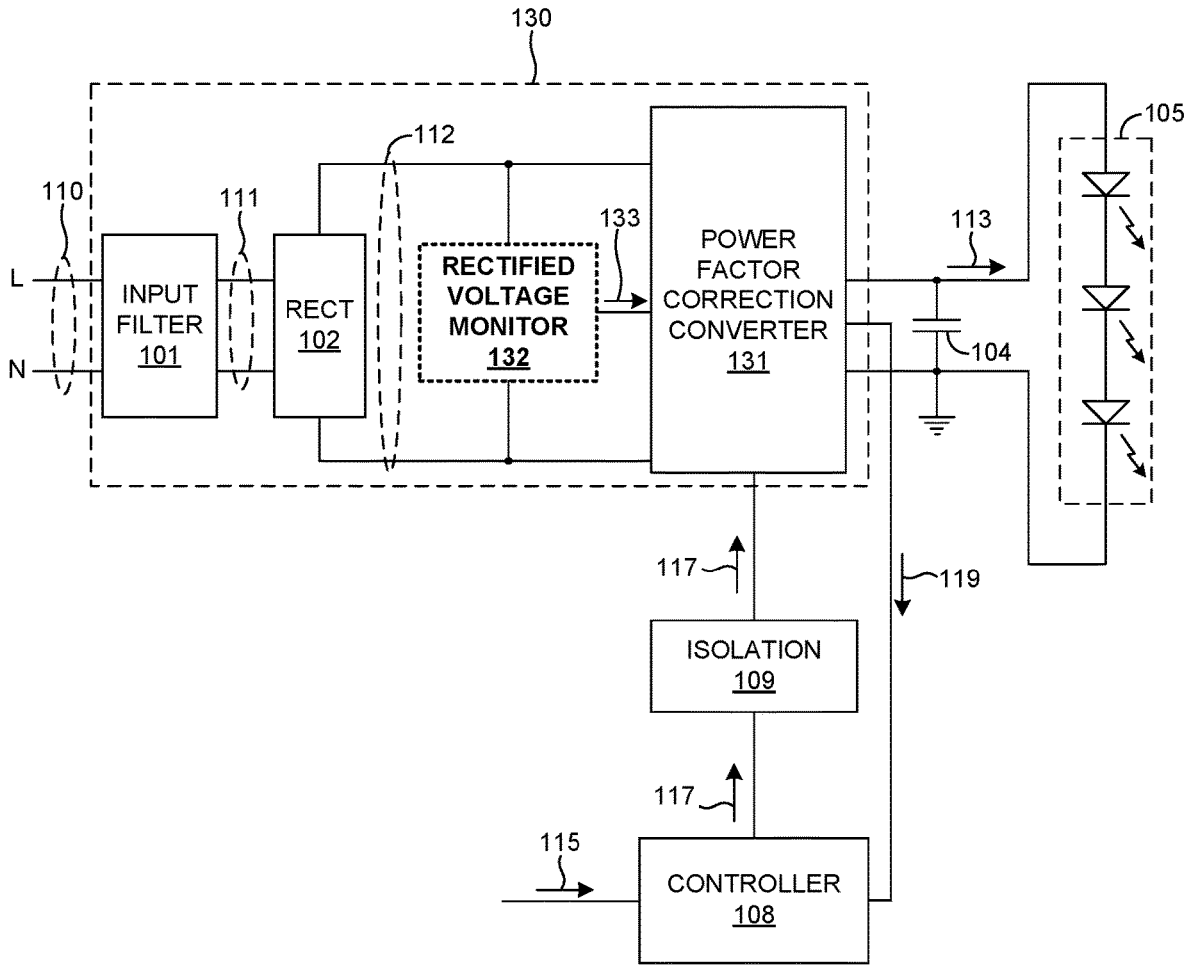
FIG. 1 depicts an illustration of an LED driver including a rectified voltage monitor in one embodiment.

FIG. 1 depicts an illustration of an LED driver in one embodiment. FIG. 1 depicts an LED string 105 including a number of LEDs electrically coupled in series. For purposes of this patent document, an LED string includes any combination of one or more LEDs electrically coupled in series, parallel, or a combination thereof. A single stage current controlled Alternating Current/Direct Current (AC/DC) converter 130 generates a controlled current employed to provide current 113 to power LED string 105 and current 119 to power controller 108. AC input signal 110 is received across input nodes, L, and N, of input filter 101. In some embodiments, AC input signal 110 is provided at a voltage at any possible value in a range from 80 VAC to 300 VAC. Input filter 101 protects the source of AC line power from unwanted electromagnetic interference by effectively blocking unwanted power spikes that may be generated by the AC/DC converter 130. Filtered AC input signal 111 is provided to rectifier 102. In one embodiment, rectifier 102 is a diode bridge that rectifies the filtered AC voltage into a rectified signal 112, e.g., a one directional half sine wave voltage signal 112. Power factor correction converter 131 is a switched mode isolated flyback converter that includes a primary side that generates a sine wave input current in phase with the rectified signal 112. This helps to achieve a high power factor (PF) and effective power factor correction (PFC). Power factor correction converter 131 also includes a secondary side that generates a controlled output current based on a command signal 117 received from controller 108. Bulk capacitor 104 filters out high frequency current components induced by switching elements of power factor correction converter 131 from the current 119 supplied to controller 108 and current 113 supplied to LED string 105.

Controller 108 controls the average lumen output of light emitted from LED string 105 by controlling the value of current 113 available to flow through LED string 105. In the embodiment depicted in FIG. 1, controller 108 communicates brightness control signal 117 to power factor correction converter 131 via isolation module 109. Isolation module electrically isolates the power factor correction converter 131 from controller 108 to prevent any human interaction with high voltages that may be present at power factor correction converter 131 and prevent any spurious spikes in electrical power from damaging controller 108. In some embodiments, isolation module 109 is implemented to transform brightness control signal 117 optically or magnetically to realize electrical isolation between controller 108 and power factor correction converter 131.

Power factor correction converter 131 receives the brightness control signal 117 indicative of a desired current flow 113 available to LED string 105. In turn, power factor correction converter 131 adjusts its output current to achieve the desired current flow, and consequently adjusts the input current flow 110 from the AC power source. In this manner, an adjustment in value of the brightness command signal changes the electrical power draw of the AC/DC converter 130 from the AC power source.

In some embodiments, controller 108 is implemented in analog format to minimize cost. In these embodiments, brightness command signal 115 is an analog signal (e.g., a signal communicated via a standard 0-10 Volt interface) received by controller 108. In turn, controller 108 generates brightness control signal 117 based on brightness command signal 115. In some embodiments, brightness control signal 117 is a PWM signal. In some other examples, brightness control signal 117 is an analog signal.

In some embodiments, controller 108 is implemented in digital format. In these embodiments, brightness command signal 115 is a digital signal (e.g., signal communicated via a standard digital interface such as digital addressable lighting interface (DALI) or a wireless communication interface such as WIFI or Bluetooth low energy (BLE)) received by controller 108.

In one aspect, AC/DC power converter 130 includes a Rectified Voltage Monitor (RVM) 132 coupled to the output of rectifier 102. RVM 132 monitors the peak voltage of rectified signal 112 and generates a low voltage, direct current monitor signal 133 indicative of the shape and peak voltage of the rectified signal 112. The monitor signal 133 and the rectified signal 112 are communicated to power factor correction converter 131 of the AC/DC converter 130.

Figure 2:
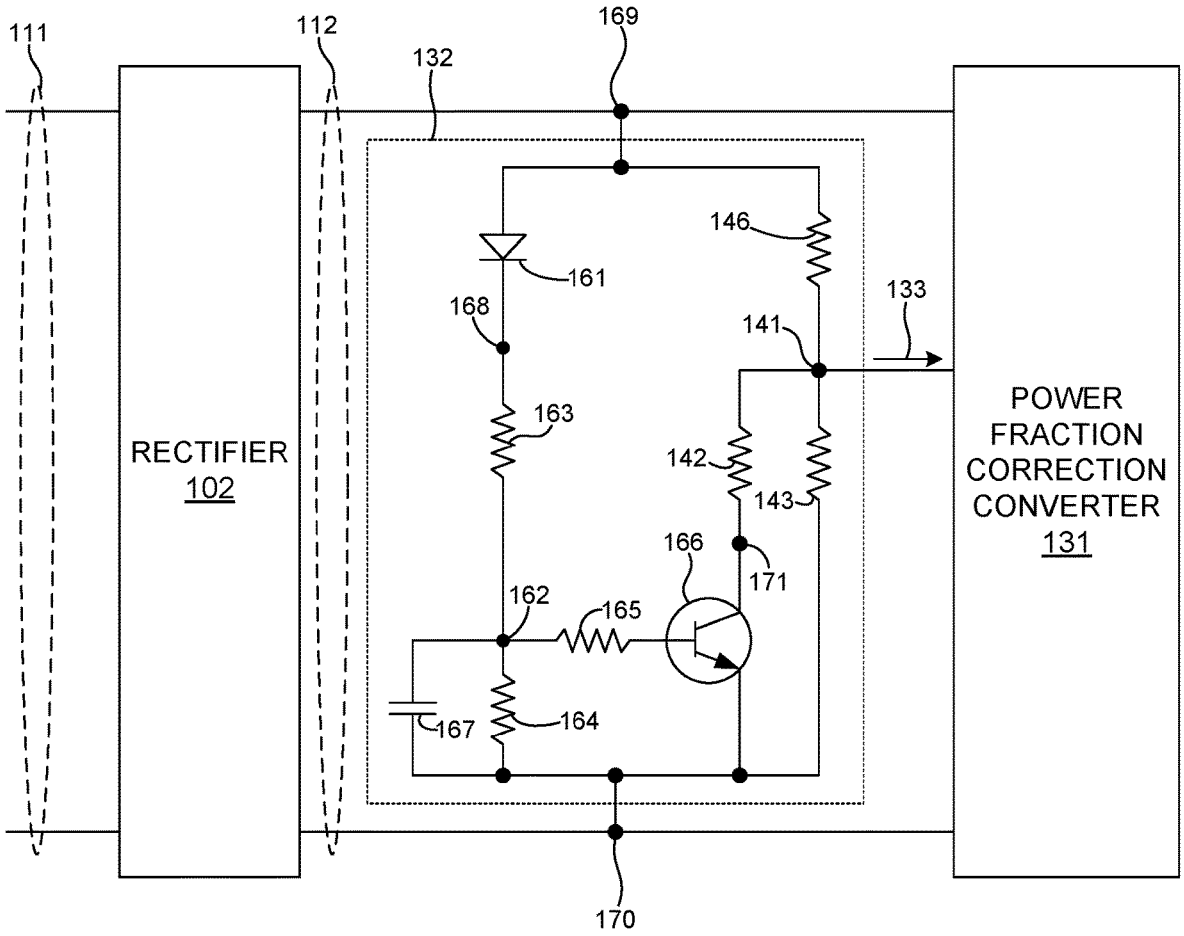
FIG. 2 depicts an illustration of an embodiment of a rectified voltage monitor in further detail.

FIG. 2 depicts RVM 132 in one embodiment. As depicted in FIG. 2, rectifier 102 receives an Alternating Current (AC) input signal 111 across input nodes of the rectifier circuit. Rectifier 102 rectifies the AC input signal and provides the rectified signal 112 across nodes 169 and 170. RVM 169 is electrically coupled to nodes 169 and 170.

In one aspect, RVM 132 operates to monitor the rectified voltage over a relatively large range of voltage values of AC input signal 111 and generate a stable, monitor signal 133 representative of the shape and amplitude of the rectified voltage signal 111. In some embodiments, the peak voltage of rectified signal 112 is in a range from 150 Volts to 450 Volts, while the corresponding peak voltage of monitor signal 133 ranges from 0 Volts to 2 Volts.

RVM 132 includes a voltage divider circuit including resistive elements 146 and 143 coupled to nodes 169 and 170. More specifically, resistive element 146 is coupled between node 169 and node 141 and resistive element 143 is coupled between node 141 and node 170. For purposes of this patent document, a resistive element is any combination of resistors coupled in series, parallel, or any combination thereof, that exhibit an overall electrical resistance. The voltage divider circuit divides down the voltage of the rectified signal present at node 169 to a reduced voltage monitor signal present node 141. As such, monitor signal 133 is a substantially scaled down representation of the instantaneous voltage of rectified signal 112. As depicted in FIG. 2, the voltage divider circuit provides monitor signal 133 present at node 141 to power fraction correction converter 131.

As depicted in FIG. 2, the voltage divider circuit divides the voltage of the rectified signal 112 by a different fraction depending on the state of electrical switching element 166. If electrical switching element 166 is substantially conductive, then resistive element 142 and the impedance of electrical switching element 166 are included in parallel with resistive element 143; effectively changing the fraction of the voltage divider circuit. If electrical switching element 166 is substantially non-conductive, then resistive element 142 and the impedance of electrical switching element 166 are not included in parallel with resistive element 143.

RVM 132 controls the state of electrical switching element 166 based on an indication of the peak voltage of the rectified signal 112. More specifically, RVM 132 includes a peak detection and voltage divider circuit including resistive elements 163 and 164, capacitive element 167, and diode 161. For purposes of this patent document, a capacitive element is any combination of electrical energy storage elements coupled in series, parallel, or any combination thereof, that exhibits an overall electrical capacitance.

Resistive elements 163 and 164 divide down the instantaneous voltage of the rectified signal 112 at node 162. The divided down value of the peak voltage of rectified signal 112 is stored on capacitive element 167. Diode 161 prevents the detected voltage from quickly discharging from capacitor 162. The divided down, peak value present on node 162 is provided to the control node of an electrical switching element, e.g., a transistor.

As depicted in FIG. 2, the peak detection and voltage divider circuit provides the divided down, peak value present at node 162 to the control node of electrical switching element 166 via resistive element 165. In the embodiment depicted in FIG. 2 electrical switching element 166 is a bipolar junction transistor. Resistive element 165 converts the voltage signal present on node 162 to a current signal provided to the base of the bipolar junction transistor. In this embodiment, the current present at the base of the bipolar junction transistor is indicative of the divided down, peak voltage of rectified signal 112. In another embodiment, electrical switching element 166 is a field effect transistor. In this embodiment, resistor 165 is not included and the gate of the field effect transistor is coupled directly to node 162. In this embodiment, the voltage present at the base of the field effect transistor is indicative of the divided down, peak voltage of rectified signal 112.

In other embodiments, a diode bridge is employed to prevent the detected voltage from quickly discharging from capacitor 167 instead of diode 161. In these embodiments, the input nodes of a diode bridge are coupled to nodes 169 and 170 and the output nodes the diode bridge are coupled to nodes 168 and 170.

Importantly, the peak detection and voltage divider circuit divides the rectified signal 112, and stores the divided-down, peak voltage signal, not the peak voltage of the rectified signal 112. As described hereinbefore, the peak voltage of the rectified signal 112 ranges from 150 Volts to 450 Volts. To directly store a peak voltage at such high voltage, an electrolytic capacitor is often employed. However, electrolytic capacitors operating at these voltage levels are prone to failure within LED drivers. By storing the divided-down, peak voltage of the rectified signal, the capacitor operates at a substantially lower voltage level. In some examples, the voltage divider of the peak detection and voltage divider circuit divides the peak voltage of the rectified signal 112 by a factor of approximately 200. In one example, the peak voltage of the rectified signal 112, ranging from 150 Volts to 450 Volts, is divided-down at node 162 to 0.75 Volts to 2.25 Volts. In these embodiments, a surface mount technology (SMT) capacitor may be employed as the storage element, thus significantly improving the reliability of an LED driver. In general, resistive elements 163 and 164 are selected to divide down the instantaneous voltage of the rectified signal 112 at node 162 to a peak voltage of less than 100 Volts.

In general, the elements of RVM 132 are selected to change the state of electrical switching element 166 depending on the peak voltage value of rectified signal 112. In one example, when the peak voltage value of rectified signal 112 is greater than 280 Volts, RVM 132 drives electrical switching element 166 to be substantially conductive. As the output terminals of the electrical switching element 166 (e.g., the collector and emitter terminals of a bipolar junction transistor or the source and drain terminals of a field effect transistor) are coupled to nodes 171 and 170, respectively, when electrical switching element 166 is substantially conductive, resistive element 142 operates in parallel with resistive element 143. Similarly, when the peak voltage value of rectified signal 112 is less than 280 Volts, RVM 132 releases electrical switching element 166 and electrical switching element 166 is substantially non-conductive. In this state, resistive element 142 does not participate as part of the voltage divider circuit including resistive elements 146 and 143.

In the embodiment depicted in FIG. 2, $R_{153}$=2 megaOhm, $R_{154}$=9.1 kiloOhm, $R_{145}$=2 megaOhm, $R_{143}$=18 kiloOhm, $R_{142}$=13 kiloOhm, and $C_{141}$=2.2 microFarads. In addition, power fraction correction converter 131 is model number MP4033GSE manufactured my Monolithic Power Systems, Inc., San Jose, Calif. (USA).

Figure 3:
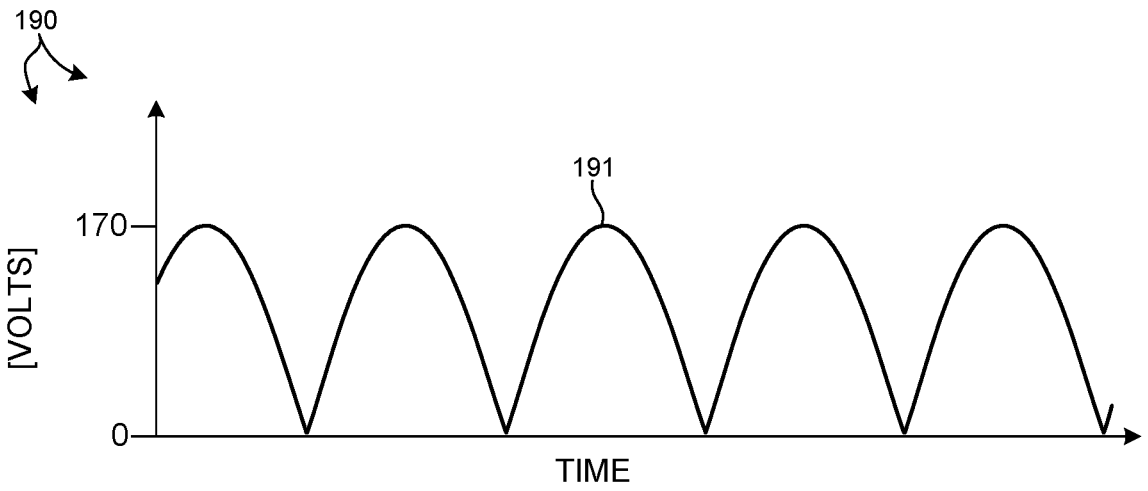
FIG. 3 depicts a plot including a waveform indicative of a time trace of the voltage output provided as input to a rectified voltage monitor for an AC input voltage of 120 Volts.

FIG. 3 depicts a plot 190 including a waveform 191 indicative of a time trace of the rectified voltage 112 generated by rectifier 102 for an AC input voltage 111 of 120 Volts. As depicted in FIG. 3, the rectified voltage 112 is a half sine wave having a peak voltage of 170 Volts. The rectified voltage 112 is provided as input to RVM 132.

Figure 4:
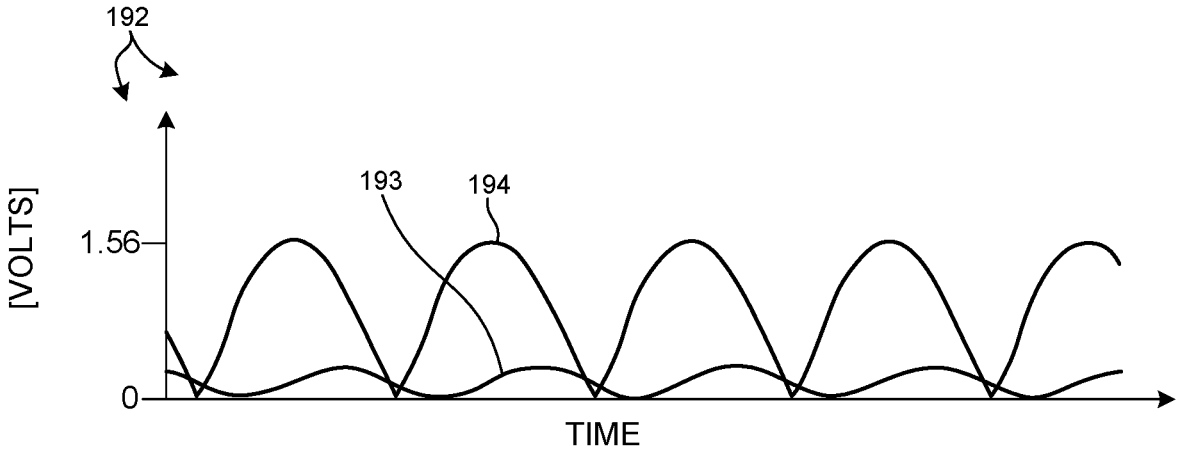
FIG. 4 depicts a plot including a waveform indicative of a time trace of the output voltage of a rectified voltage monitor and a waveform indicative of a time trace of the voltage stored across a capacitor of the rectified voltage monitor for an AC input voltage of 120 Volts.

FIG. 4 depicts a plot 192 including a waveform 193 indicative of a time trace of the voltage stored across capacitor 167 of the rectified voltage monitor 132 for an AC input voltage of 120 Volts. In addition, FIG. 4 depicts a plot including a waveform 194 indicative of a time trace of the voltage of monitor signal 133 communicated to power factor correction converter 131 of the AC/DC converter 130 for an AC input voltage of 120 Volts. As depicted in FIG. 4, the amplitude of monitor signal 133 is 1.56 Volts, and the amplitude of the voltage stored on capacitor 167 is approximately 250 millivolts. At this voltage level, electrical switching element 171 remains substantially non-conductive. As a result, the impedance of electrical switching element 166 and the resistance of resistive element 142 do not substantially participate in the voltage division at node 141.

Figure 5:
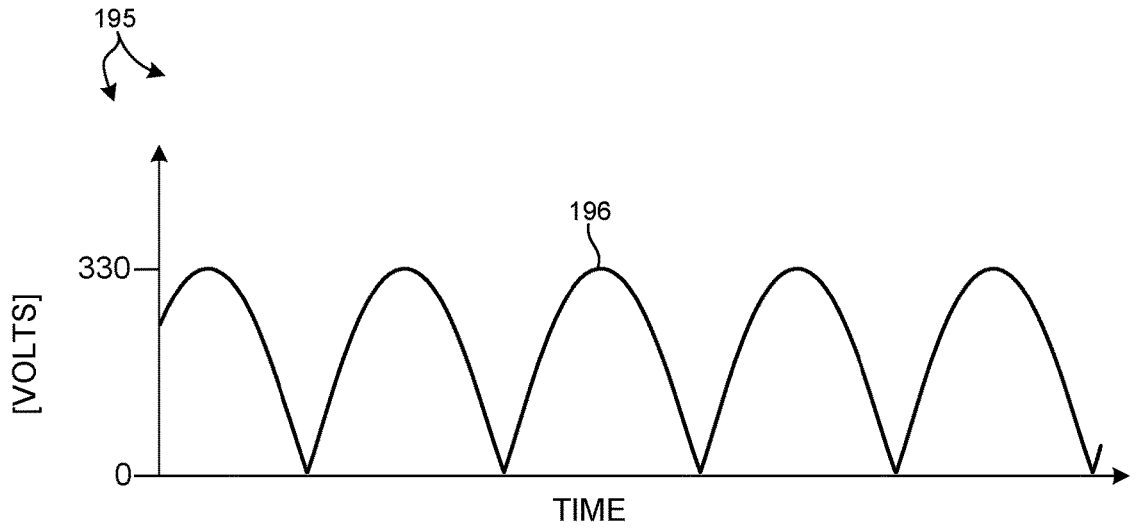
FIG. 5 depicts a plot including a waveform indicative of a time trace of the voltage output provided as input to a rectified voltage monitor for an AC input voltage of 230 Volts.

FIG. 5 depicts a plot 195 including a waveform 196 indicative of a time trace of the rectified voltage 112 generated by rectifier 102 for an AC input voltage 111 of 230 Volts. As depicted in FIG. 5, the rectified voltage 112 is a half sine wave having a peak voltage of 330 Volts. The rectified voltage 112 is provided as input to RVM 132.

Figure 6:
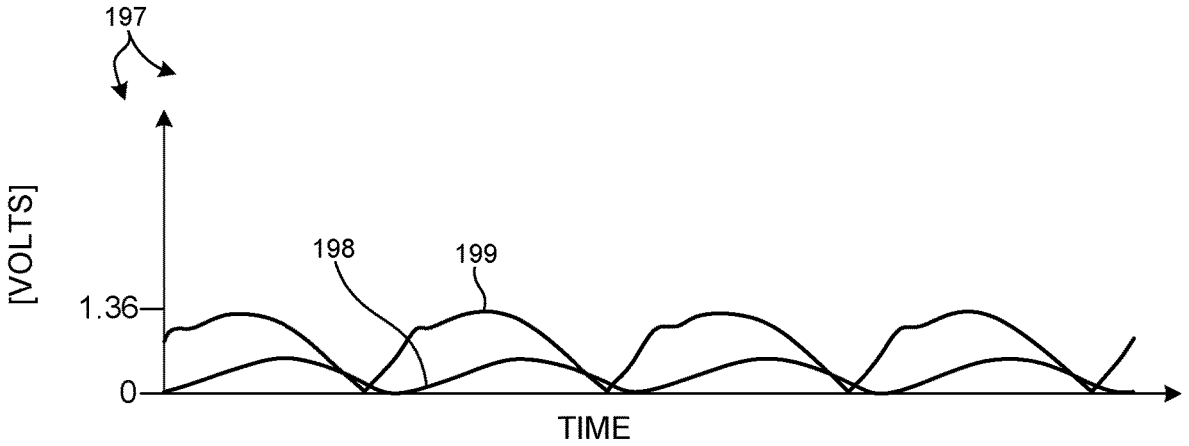
FIG. 6 depicts a plot including a waveform indicative of a time trace of the output voltage of a rectified voltage monitor and a waveform indicative of a time trace of the voltage stored across a capacitor of the rectified voltage monitor for an AC input voltage of 230 Volts.

FIG. 6 depicts a plot 197 including a waveform 198 indicative of a time trace of the voltage stored across capacitor 167 of the rectified voltage monitor 132 for an AC input voltage of 230 Volts. In addition, FIG. 6 depicts a plot including a waveform 199 indicative of a time trace of the voltage of monitor signal 133 communicated to power factor correction converter 131 of the AC/DC converter 130 for an AC input voltage of 230 Volts. As depicted in FIG. 6, the amplitude of monitor signal 133 is 1.36 Volts, and the amplitude of the voltage stored on capacitor 167 is approximately 500 millivolts. At this voltage level, electrical switching element 171 is substantially conductive. As a result, the impedance of electrical switching element 166 and the resistance of resistive element 142 substantially participate in the voltage division at node 141. As illustrated in FIGS. 4 and 6, the amplitude of the monitor signal 133 is lower for an AC input voltage of 230 Volts compared to the amplitude of the monitor signal 133 associated with an AC input voltage of 120 Volts.

Figure 7:
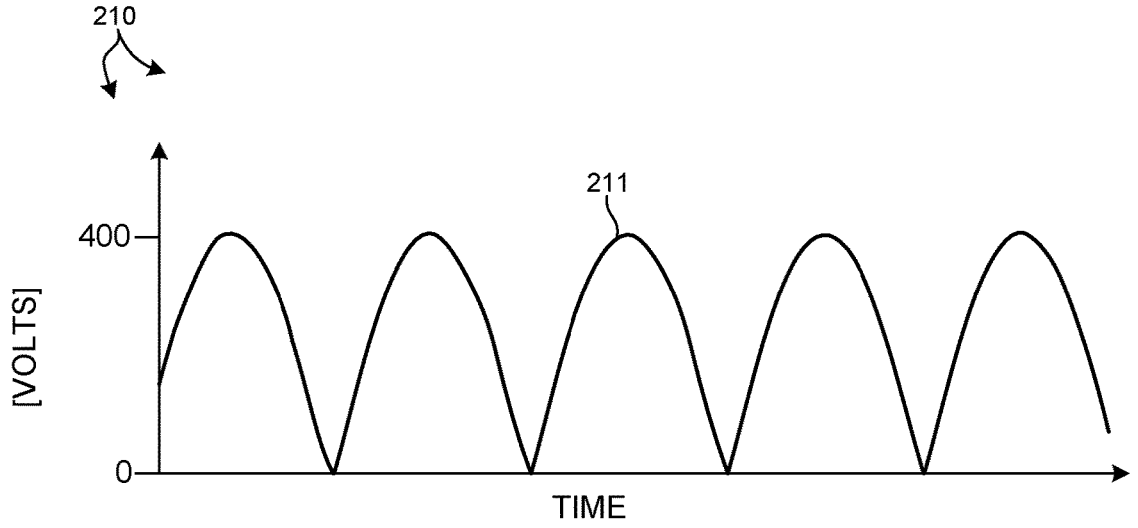
FIG. 7 depicts a plot including a waveform indicative of a time trace of the voltage output provided as input to a rectified voltage monitor for an AC input voltage of 277 Volts.

FIG. 7 depicts a plot 210 including a waveform 211 indicative of a time trace of the rectified voltage 112 generated by rectifier 102 for an AC input voltage 111 of 277 Volts. As depicted in FIG. 7, the rectified voltage 112 is a half sine wave having a peak voltage of 400 Volts. The rectified voltage 112 is provided as input to RVM 132.

Figure 8:
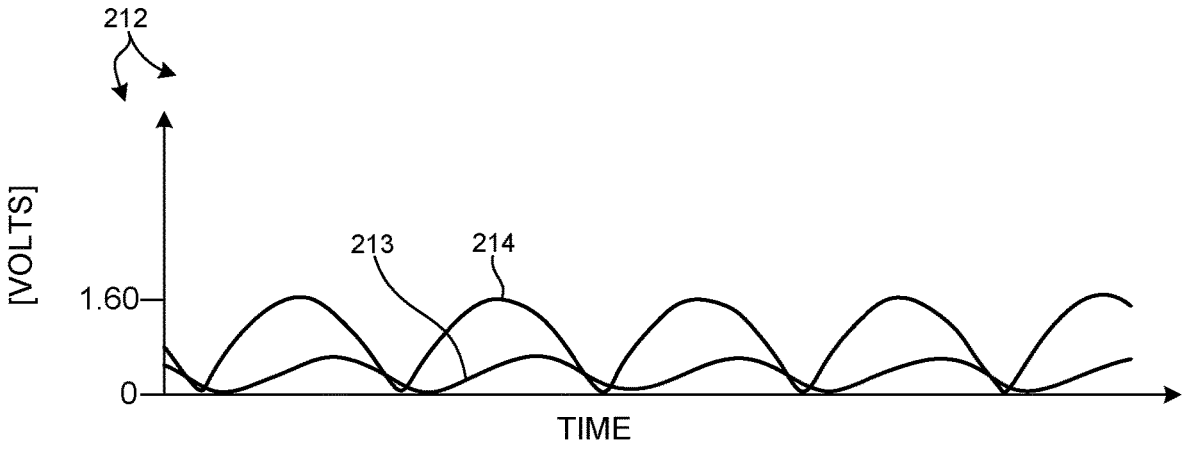
FIG. 8 depicts a plot including a waveform indicative of a time trace of the output voltage of a rectified voltage monitor and a waveform indicative of a time trace of the voltage stored across a capacitor of the rectified voltage monitor for an AC input voltage of 277 Volts.

FIG. 8 depicts a plot 212 including a waveform 213 indicative of a time trace of the voltage stored across capacitor 167 of the rectified voltage monitor 132 for an AC input voltage of 277 Volts. In addition, FIG. 8 depicts a waveform 214 indicative of a time trace of the voltage of monitor signal 133 communicated to power factor correction converter 131 of the AC/DC converter 130 for an AC input voltage of 277 Volts. As depicted in FIG. 8, the amplitude of monitor signal 133 is 1.60 Volts, and the amplitude of the voltage stored on capacitor 167 is approximately 575 millivolts. At this voltage level, electrical switching element 171 is substantially conductive. As a result, the impedance of electrical switching element 166 and the resistance of resistive element 142 substantially participate in the voltage division at node 141. As illustrated in FIGS. 6 and 8, the amplitude of the monitor signal 133 is higher for an AC input voltage of 277 Volts compared to the amplitude of the monitor signal 133 associated with an AC input voltage of 230 Volts.

Power converter 131 employs monitor signal 133 as input to the internal error amplifier used to stabilize the LED current output generated by the power converter for a range of AC input voltage. Power converter 131 relies on monitor signal 133 to represent the shape of the waveform of rectified voltage signal 112 and the magnitude of monitor signal 133 to represent the maximum voltage of the rectified voltage signal 112. If the amplitude of monitor signal 133 provided to power converter 131 exceeds approximately 2 Volts, the power converter operates in an unstable manner and fails to provide a stable current supply to the LEDs.

As illustrated by FIGS. 3-8, the AC input voltage ranges from 120 Volts to 277 Volts. Over this large range of input voltages, the amplitude of monitor signal 133 provided to power converter 131 is stabilized below 2 Volts. If simple voltage division were applied, e.g., resistive elements 146 and 143, rather than RVM 132, the amplitude of monitor signal 133 would be approximately 3 Volts for an AC input voltage of 230 Volts and approximately 3.3 Volts for an AC input voltage of 277 Volts, which exceeds the range of stable operation of power converter 131.

In addition, as illustrated by FIGS. 3-8, the peak voltage stored on capacitor 167 is less than 2 Volts over an AC input voltage range from 120 Volts to 277 Volts. By storing such a low voltage, a SMT capacitor may be utilized, rather than a high voltage electrolytic capacitor. In the illustrated embodiment, the ratio of resistance of resistive elements 163 and 164 is selected such that the voltage present on node 162 is approximately 1/200 of the voltage present on node 169. However, in general, any suitable ratio of resistances may be employed to ensure that the voltage stored across capacitive element 167 is less than 100 Volts, less than 60 Volts, less than 10 Volts, or less than 5 Volts.

Figure 9:
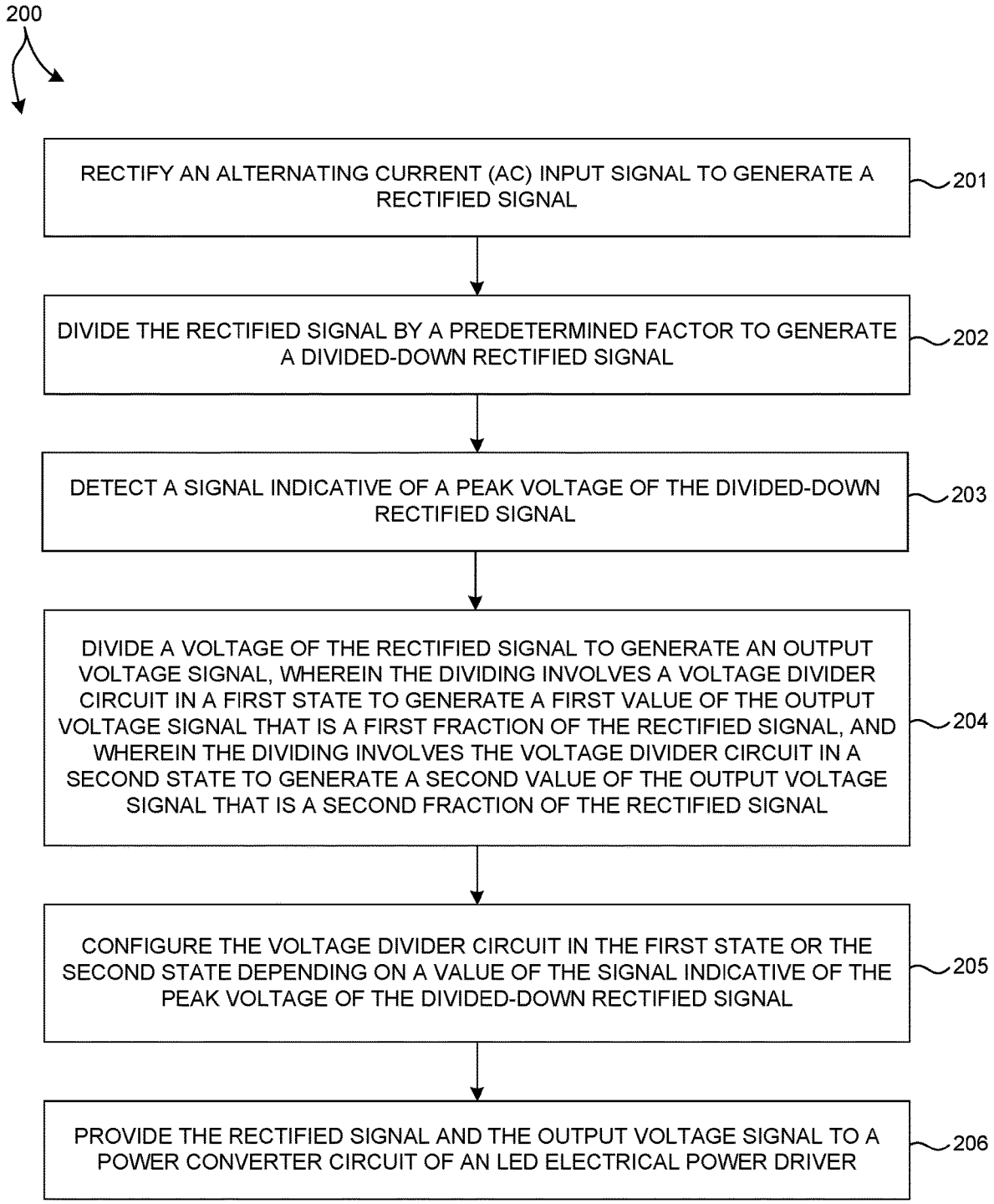
FIG. 9 depicts a flowchart illustrative of a method for monitoring the rectified voltage of an LED driver over a large range of AC input voltage in at least one novel aspect.

FIG. 9 illustrates a method 200 suitable for implementation by any of the described embodiments of the present invention. While the following description is presented in the context of the described embodiments, it is recognized herein that the particular structural aspects of the described embodiments do not represent limitations and should be interpreted as illustrative only.

In block 201, an Alternating Current (AC) input signal is rectified to generate a rectified signal.

In block 202, the rectified signal is divided by a predetermined factor to generate a divided-down rectified signal.

In block 203, a signal indicative of a peak voltage of the divided-down rectified signal is detected.

In block 204, a voltage of the rectified signal is divided to generate an output voltage signal. The dividing involves a voltage divider circuit in a first state to generate a first value of the output voltage signal that is a first fraction of the rectified signal, and in a second state to generate a second value of the output voltage signal that is a second fraction of the rectified signal.

In block 205, the voltage divider circuit is configured in the first state or the second state depending on a value of the signal indicative of the peak voltage of the divided-down rectified signal.

In block 206, the rectified signal and the output voltage signal are provided to a power converter circuit of an LED electrical power driver.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An LED electrical power driver, comprising:

a rectifier having a first input node and a second input node and a first output node and a second output node, wherein an Alternating Current (AC) input signal is provided across the first and second input nodes, and wherein a rectified signal is provided by the rectifier across the first and second output nodes;

a power converter circuit having a first input node, a second input node, and a third input node, wherein the rectified signal is provided across the first and second input nodes of the power converter circuit; and a rectified voltage monitor electrically coupled to the first, second, and third input nodes of the power converter circuit, the rectified voltage monitor comprising:

a voltage divider and peak detection circuit configured to divide the rectified signal by a predetermined factor to generate a divided-down rectified signal and detect a signal indicative of a peak voltage of the divided-down rectified signal;

an electrical switching element having a control node, a first output node coupled to the second input node of the power converter circuit, and a second output node, wherein the signal indicative of the peak voltage of the divided-down rectified signal is communicated to the control node, wherein the electrical switching element is substantially conductive when the signal indicative of the peak voltage is greater than a first predetermined threshold value, and wherein the electrical switching element is substantially non-conductive when the signal indicative of the peak voltage is less than a second predetermined threshold value; and a voltage divider circuit including a first resistive element coupled between the first and third input nodes of the power converter circuit, a second resistive element coupled between the third input node of the power converter circuit and the second output node of the electrical switching element, and a third resistive element coupled between the third input node of the power converter circuit and the second input node of the power converter circuit.

2. The LED electrical power driver of claim 1, wherein the electrical switching element is a bipolar junction transistor or a field effect transistor.

3. The LED electrical power driver of claim 1, wherein the AC input signal is any AC voltage in a range from 80 Volts to 300 Volts.

4. The LED electrical power driver of claim 1, wherein the voltage divider and peak detection circuit includes a diode and a capacitor.

5. The LED electrical power driver of claim 4, wherein the peak voltage of the divided-down rectified signal stored on the capacitor is less than 100 Volts.

6. The LED electrical power driver of claim 4, wherein the peak voltage of the divided-down rectified signal stored on the capacitor is less than 10 Volts.

7. The LED electrical power driver of claim 1, wherein a voltage at the third input node of the power converter circuit is less than 2 Volts when the AC input signal is any AC voltage in a range from 80 Volts to 300 Volts.

8. An LED electrical power driver, comprising:

a rectifier configured to receive an Alternating Current (AC) input signal and generate a rectified signal;

a power converter circuit electrically coupled to the rectifier, wherein the rectified signal is provided to the power converter circuit;

a rectified voltage monitor electrically coupled to the power converter circuit, the rectified voltage monitor comprising:

a voltage divider circuit electrically coupled to the power converter circuit, wherein the voltage divider circuit generates an output voltage signal communicated to the power converter circuit that is a fraction of the rectified signal, wherein the voltage divider circuit in a first state generates a first value of the output voltage that is a first fraction of the rectified signal, and wherein the voltage divider circuit in a second state generates a second value of the output voltage that is a second fraction of the rectified signal;

a voltage divider and peak detection circuit configured to divide the rectified signal by a predetermined factor to generate a divided-down rectified signal and detect a signal indicative of a peak voltage of the divided-down rectified signal; and an electrical switching element having a control node, wherein the electrical switching element receives the divided-down rectified signal and configures the voltage divider circuit in the first state or the second state depending on a value of the divided-down rectified signal.

9. The LED electrical power driver of claim 8, wherein the electrical switching element is a bipolar junction transistor or a field effect transistor.

10. The LED electrical power driver of claim 8, wherein the AC input signal is any AC voltage in a range from 80 Volts to 300 Volts.

11. The LED electrical power driver of claim 8, wherein the voltage divider and peak detection circuit includes a diode and a capacitor.

12. The LED electrical power driver of claim 11, wherein the peak voltage of the divided-down rectified signal stored on the capacitor is less than 100 Volts.

13. The LED electrical power driver of claim 11, wherein the peak voltage of the divided-down rectified signal stored on the capacitor is less than 10 Volts.

14. The LED electrical power driver of claim 8, wherein a voltage at the third input node of the power converter circuit is less than 2 Volts when the AC input signal is any AC voltage in a range from 80 Volts to 300 Volts.

15. A method comprising:

rectifying an Alternating Current (AC) input signal to generate a rectified signal;

dividing the rectified signal by a predetermined factor to generate a divided-down rectified signal;

detecting a signal indicative of a peak voltage of the divided-down rectified signal;

dividing a voltage of the rectified signal to generate an output voltage signal, wherein the dividing involves a voltage divider circuit in a first state to generate a first value of the output voltage signal that is a first fraction of the rectified signal, and wherein the dividing involves the voltage divider circuit in a second state to generate a second value of the output voltage signal that is a second fraction of the rectified signal;

configuring the voltage divider circuit in the first state or the second state depending on a value of the signal indicative of the peak voltage of the divided-down rectified signal; and providing the rectified signal and the output voltage signal to a power converter circuit of an LED electrical power driver.

16. The method of claim 15, wherein the configuring the voltage divider circuit involves:

switching an electrical switching element to a substantially conductive state when the signal indicative of the peak voltage of the divided-down rectified signal is greater than a first predetermined threshold value; and switching the electrical switching element to a substantially non-conductive state when the signal indicative of the peak voltage of the divided-down rectified signal is less than a second predetermined threshold value.

17. The method of claim 16, wherein the electrical switching element is a bipolar junction transistor or a field effect transistor.

18. The method of claim 15, wherein the AC input signal is any AC voltage in a range from 80 Volts to 300 Volts.

19. The method of claim 15, wherein the voltage output signal is less than 2 Volts when the AC input signal is any AC voltage in a range from 80 Volts to 300 Volts.

20. The method of claim 15, further comprising:

storing the signal indicative of the peak voltage of the divided-down rectified signal on a capacitor, wherein the stored signal is less than 100 Volts.

* * * * *